United States Patent [19]

Wincze

[11] Patent Number: 4,474,143

[45] Date of Patent: Oct. 2, 1984

[54] RETRACTABLE MAINTENANCE PLATFORM STORED OUTSIDE OF THE FURNACE

[75] Inventor: Steven P. Wincze, Windsor, Conn.

[73] Assignee: Combustion Engineering, Inc., Windsor, Conn.

[21] Appl. No.: 524,624

[22] Filed: Aug. 19, 1983

[51] Int. Cl.[3] ..... F22B 37/18

[52] U.S. Cl. ..... 122/379; 122/4 R

[58] Field of Search ..... 122/379, 396, 1 R, 6 R, 122/4 R, 510; 110/233, 234, 349

[56] References Cited

FOREIGN PATENT DOCUMENTS 158811 2/1983 Fed. Rep. of Germany ..... 122/379

*Primary Examiner*—Edward G. Favors

*Attorney, Agent, or Firm*—Robert L. Olson

[57] ABSTRACT

A maintenance platform is provided for gaining access to the upper area of the furnace (10) of a steam generator that can be quickly and easily assembled during a maintenance shutdown. The main beams (26) forming the framework of the platform are supported both from the furnace walls (42, 44) and also from the furnace roof (32, 34, 38). These beams, which are of considerable length, are stored outside of the furnace in a nearly vertical position when not in use, and are guided into the furnace by a plurality of rollers (40), so as to keep the beams in a single plane close to the outer furnace wall while they are being moved into the furnace.

3 Claims, 6 Drawing Figures

RETRACTABLE MAINTENANCE PLATFORM STORED OUTSIDE OF THE FURNACE

BACKGROUND OF THE INVENTION

This invention is directed to a maintenance platform to permit access to the upper region of the furnace of a steam generator. Access to remove slag, or inspect and repair tubes of a superheater extending down from the roof of the furnace is almost always necessary during a scheduled maintenance shutdown of a steam generator, which may occur annually. To presently construct and install a temporary maintenance platform on which workmen can safely reach the superheater area takes time, generally necessitating a lengthy and costly downtime of the steam generator. Also, space requirements outside of the furnace in which to store the platform components and manipulate them during installation within the furnace, is critical.

SUMMARY OF THE INVENTION

In accordance with the invention, a maintenance platform is provided for reaching the upper area of the furnace of a steam generator. This platform can be quickly and easily constructed during a scheduled shutdown. The main beams forming the framework of the platform are supported both from the furnace walls, and also from the furnace roof. These beams, which are of considerable length, are stored outside of the furnace in a nearly vertical position when not in use, and are guided into the furnace by a plurality of rollers, so as to keep the beams in a single plane close to the outer furnace wall while they are being moved into their working positions.

DESCRIPTION OF THE PREFERRED EMBODIMENT

Figure 1:
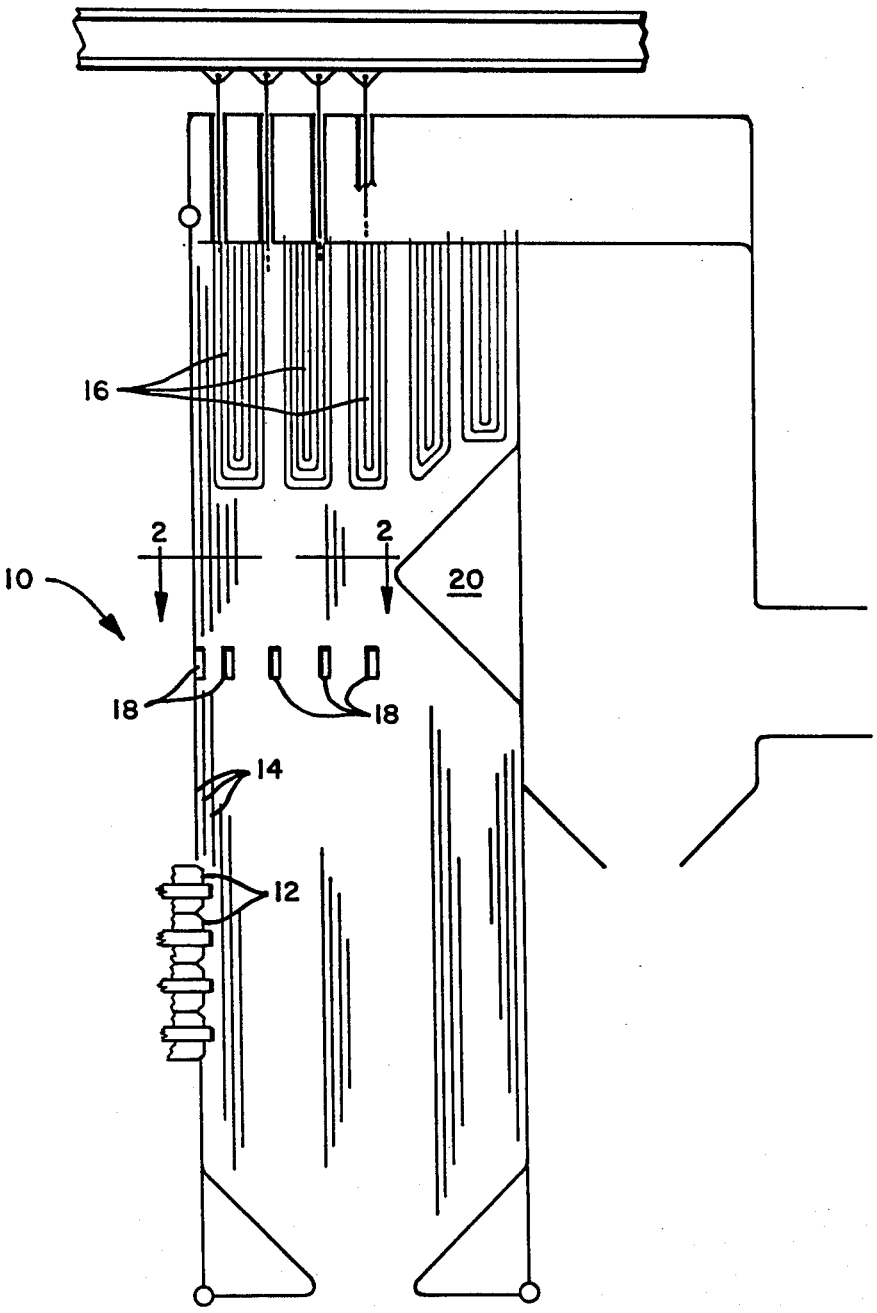
FIG. 1 is a sectional elevation of the furnace of a steam generator.

Looking now to FIG. 1, the furnace 10 of a steam generator is shown in which burners 12 are provided for burning coal therein. The walls of the furnace are lined with water-cooled tubes 14, and in the upper portion of the furnace is located pendent superheaters 16. During regularly scheduled maintenance shutdowns, it sometimes is necessary for workmen to gain access to the upper portion of the furnace, for example to remove slag from the superheater panels.

Figure 2:
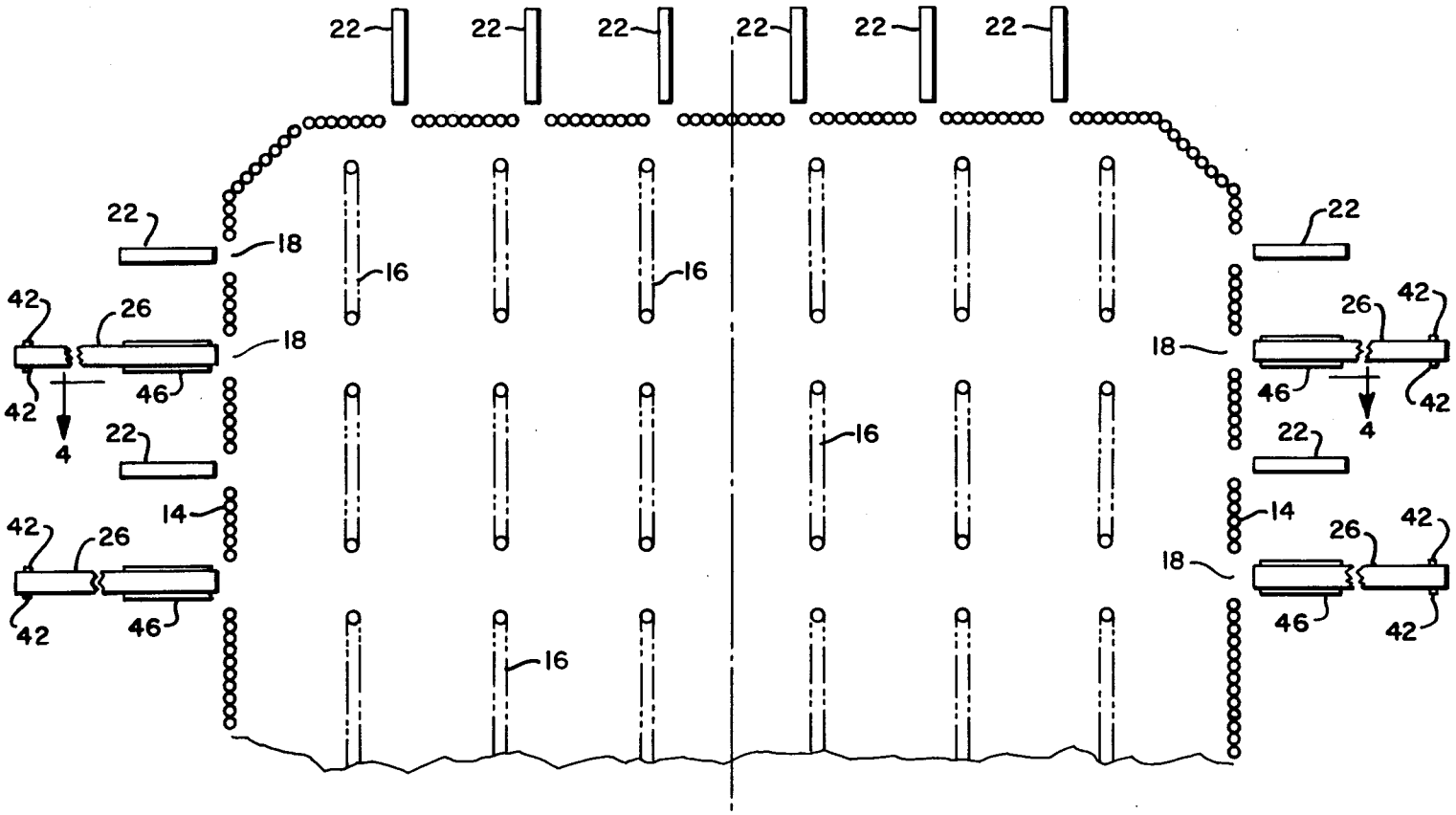
FIG. 2 is a view taken on line 2—2 of FIG. 1.
Figure 3:
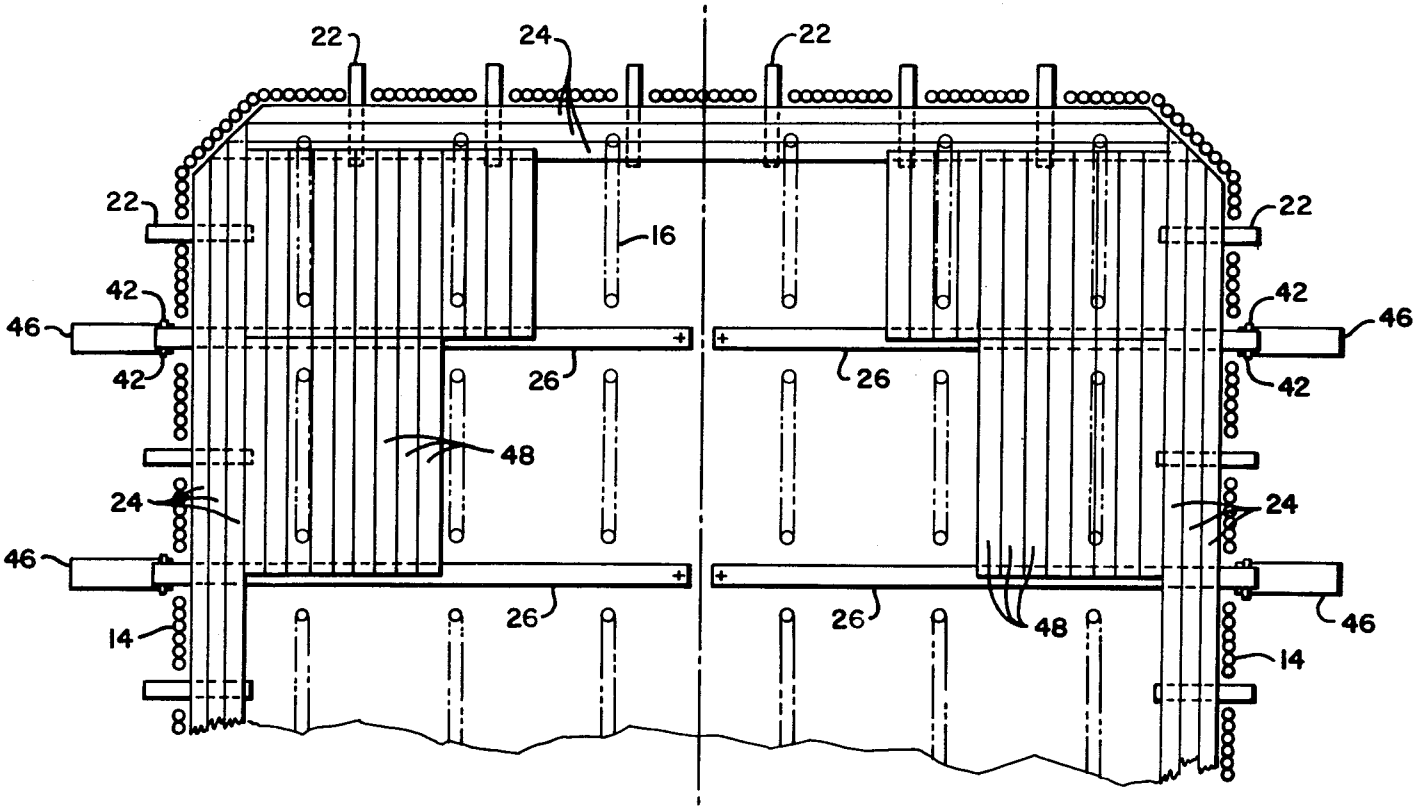
FIG. 3 is a view similar to FIG. 2, showing much of the scaffolding in place.

As shown in FIGS. 1–3, there are a plurality of small, spaced openings 18 in all four furnace walls at about the height of the nose arch 20, just beneath the superheaters 16. These openings would be covered by removable doors during normal operation of the boiler. During a maintenance shutdown, the doors are removed so that the platform framework can be installed in the furnace.

As shown in FIG. 2, a plurality of beams 22 are located outside of the furnace adjacent the openings 18.

These beams are supported on rollers such that they can be moved into the boiler during a maintenance shutdown. Planks 24 can then be placed between adjacent beams 22 so as to form a perimeter scaffold adjacent the furnace walls, as shown in FIG. 3.

Figure 4:
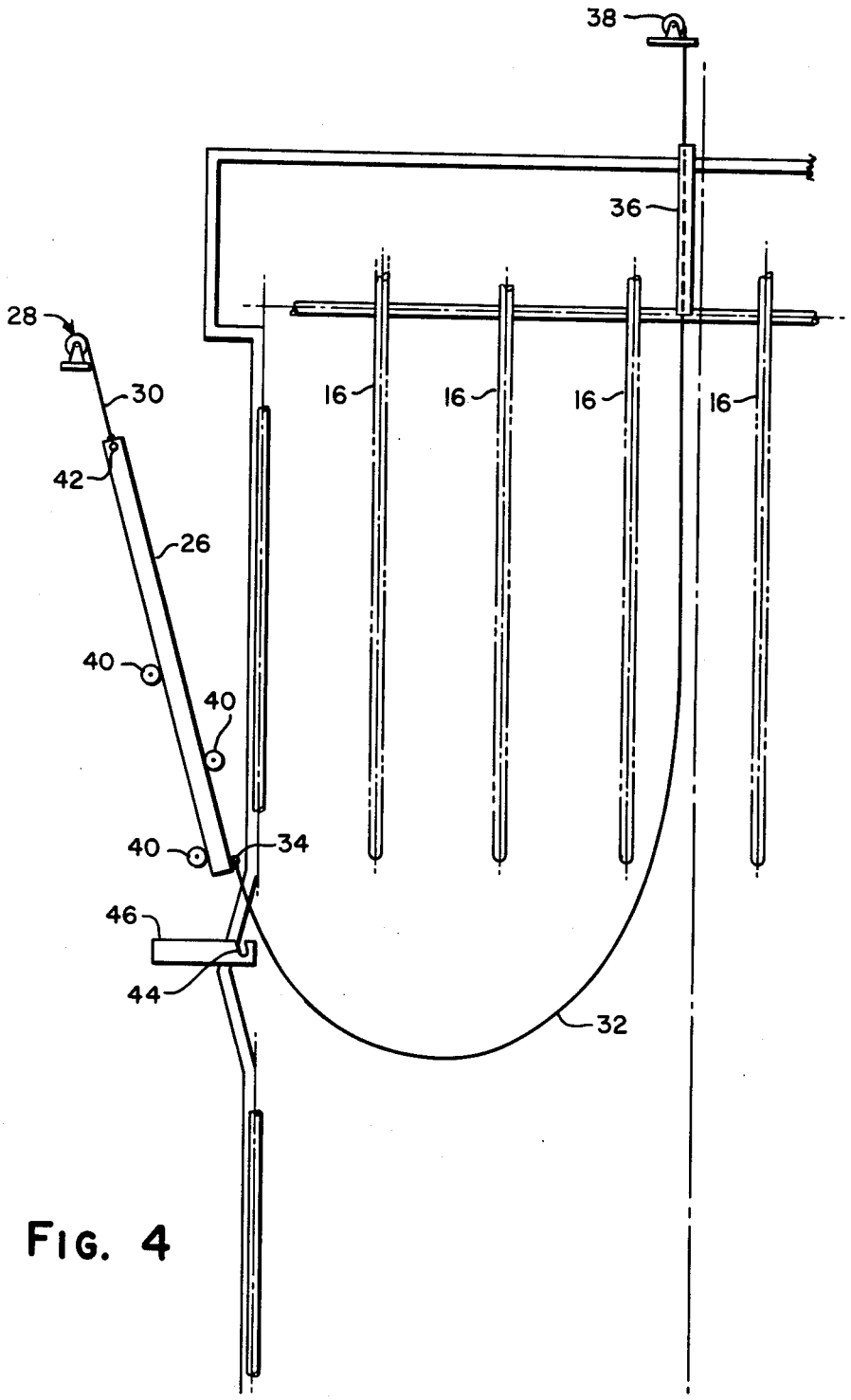
FIG. 4 is a partial sectional elevation taken on line 4—4 of FIG. 2.
Figure 5:
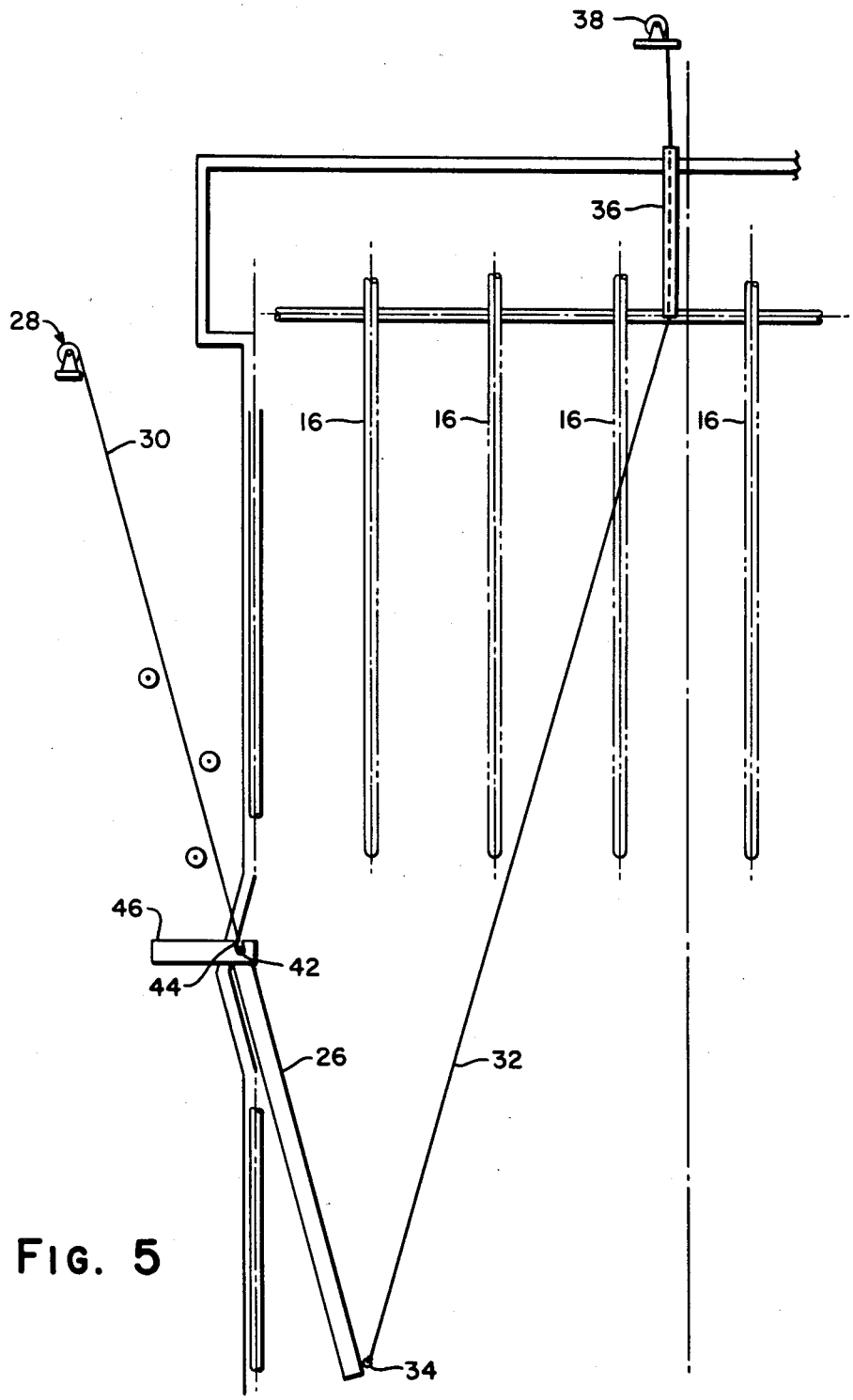
FIG. 5 is a view similar to FIG. 4, with the main platform beams extended into the furnace.

Looking now to FIG. 4, the main support beams 26 are shown in their stored position, outside of the furnace 10. These beams lie almost parallel to the furnace walls, and thus require little space for storage purposes. Little space is also needed to manipulate the beams into the furnace, as will be described below. As shown, there are four main beams 26, two being on either furnace side. A hoist arrangement 28 is provided for each beam, with a cable 30 being attached to the end of each beam. When it is desired to extend the beams into the furnace, the hoist lowers the beam 26 downwardly, at a slight angle to the vertical (10°–15°). Cables 32 are secured to the lower ends of the beams by hooks 34 prior to lowering. These cables extend down through openings 36 in the furnace roof, and are attached to hoists 38. A plurality of guide rolls 40 maintain each beam in a single plane during its movement from the stored position until it is extending downwardly into the furnace to prevent it from hitting the furnace walls, which might cause damage. When in the lowered position (FIG. 5), a pair of pins 42 secured to either side of each beam engages a slot 44 in an outer beam support member 46. These supports 46 are attached to and supported by the boiler support steel (not shown).

Figure 6:
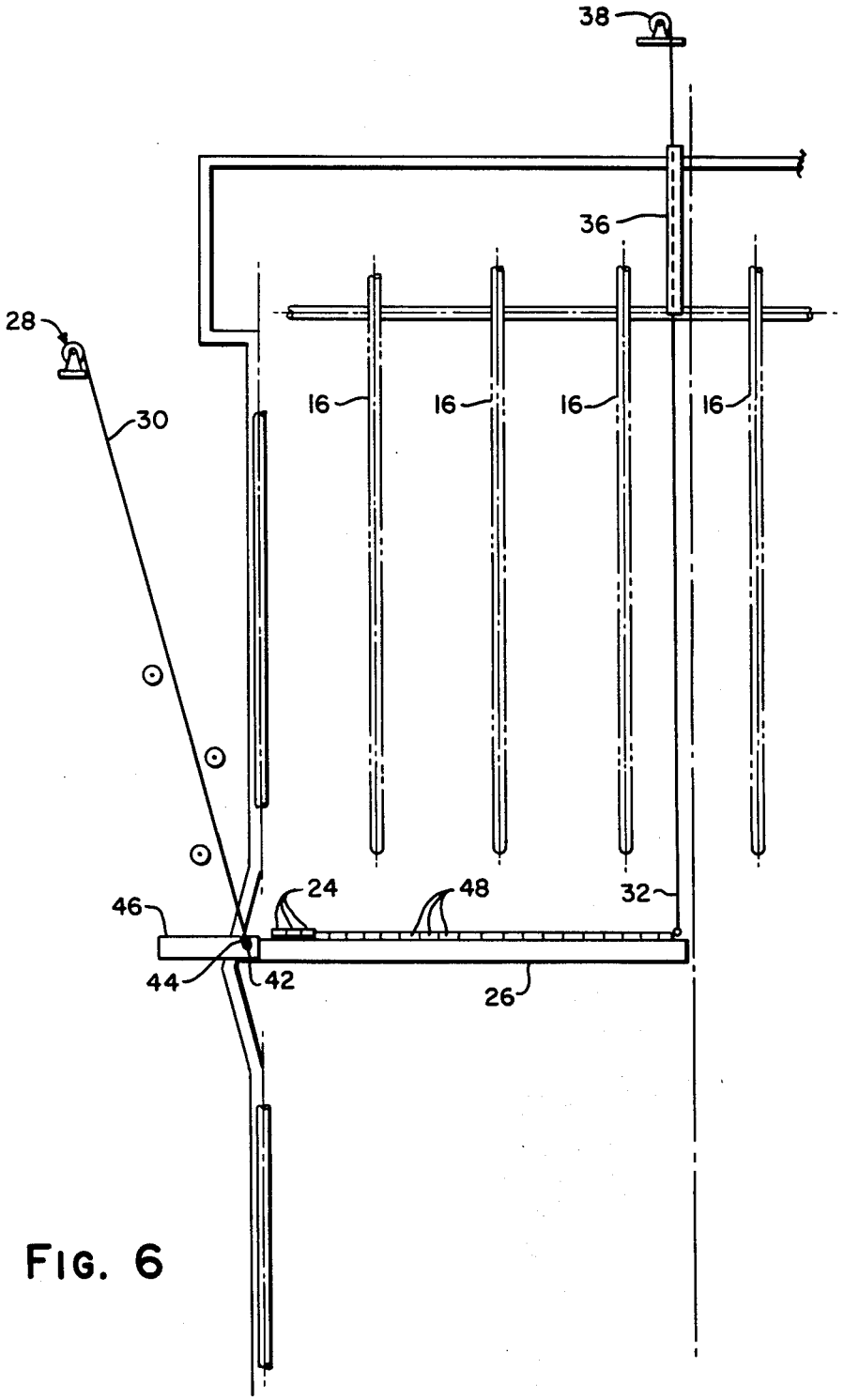
FIG. 6 is a view similar to FIGS. 4 and 5, with the main platform beams in operating position.

Hoists 38 are then actuated to raise the main support beams 26 to a horizontal position, as shown in FIG. 6. Planks 48 can then be placed between the beams 26 and the perimeter scaffolding, and also between the beams 26 themselves, to form a complete maintenance platform on which workmen can stand while working on the superheater panels 16.

I claim:

1. A furnace having four enclosing walls and a roof, with steam generating tubes lining the walls, steam superheating tubes extending down into the furnace from the roof, first openings in one wall of the furnace at an elevation subjacent to the superheating tubes, a first support beam associated with each opening, first means for moving the first beams into and out of the furnace through their associated openings, said first means including winch means including first cable means attached to a first end of each first beam, for holding the first beam in a first position outside of the furnace, the first beams in the first position lying at an angle closer to the vertical than the horizontal, second cable means extending down through openings in the furnace roof adapted to be attached to the second end of each first beam, so that when the first beams have been lowered substantially all of the way into the furnace by means of their winch means, the second ends can be raised by the second cable means until the first beams are in a second horizontal position, means for supporting the first ends of the first beams from a position outside of the furnace, when the first beams are in the horizontal position substantially within the furnace, means by which second support beams can be positioned and supported within the furnace adjacent each of the walls adjacent to said one wall, so that plank means can be positioned between the first and second support beams, thereby forming a removable platform within the furnace for supporting workmen thereon during a furnace maintenance shutdown.

2. The furnace of claim 1, including rollers for guiding and supporting the first beams in a single plane while they are being moved from their first position to their second position.

3. The furnace of claim 2, wherein the means for supporting the first ends of the first beams in their second position is a pin and slot arrangement.

* * * * *